US006779459B2

(12) United States Patent
Werner

(10) Patent No.: US 6,779,459 B2
(45) Date of Patent: Aug. 24, 2004

(54) PYROTECHNIC PROJECTILE LAUNCHER

(75) Inventor: John A. Werner, North East, MD (US)

(73) Assignee: Hunter Pacific Limited, Tortola (VG)

( * ) Notice: Subject to any disclaimer, the term of this patent is extended or adjusted under 35 U.S.C. 154(b) by 0 days.

(21) Appl. No.: 10/187,558

(22) Filed: Jul. 2, 2002

(65) Prior Publication Data

US 2004/0003744 A1 Jan. 8, 2004

(51) Int. Cl.[7] ..... F42B 4/06; F42B 4/08; F42B 4/14; F42B 4/04; A63H 5/00

(52) U.S. Cl. ..... 102/349; 102/343; 102/345; 102/348; 102/352; 102/361; 449/399; 449/212

(58) Field of Search ..... 102/334, 336, 102/361, 335, 341, 343, 344, 345, 347, 348, 349, 352, 356, 358, 360; 446/56, 211, 212, 398, 399

(56) References Cited

U.S. PATENT DOCUMENTS

| | | | | | |
|---|---|---|---|---|---|
| 1,299,217 | A | * | 4/1919 | Pain | 102/361 |
| 1,783,999 | A | * | 12/1930 | Cimorosi | 102/361 |
| 2,174,202 | A | * | 9/1939 | Cimorosi | 102/361 |
| 2,918,751 | A | | 12/1959 | Johnson | 46/74 |
| 3,292,302 | A | * | 12/1966 | Estes et al. | 446/212 |
| 3,424,409 | A | | 1/1969 | Stanley | 244/122 |
| 4,295,290 | A | * | 10/1981 | Boswell | 446/45 |
| 4,724,768 | A | | 2/1988 | Robinson | 102/349 |
| 4,917,015 | A | | 4/1990 | Lowery | 102/342 |
| 5,499,582 | A | * | 3/1996 | Schiessl et al. | 102/334 |
| 5,979,329 | A | * | 11/1999 | Collar | 102/361 |
| 6,155,173 | A | * | 12/2000 | Bellino | 102/349 |
| 6,209,461 | B1 | * | 4/2001 | Riffet et al. | 102/513 |
| 6,283,033 | B1 | * | 9/2001 | Wu et al. | 102/352 |
| 6,286,429 | B1 | * | 9/2001 | Marietta et al. | 102/342 |
| 6,289,815 | B1 | * | 9/2001 | Tougeron et al. | 102/302 |
| 6,315,629 | B1 | | 11/2001 | Jones | 446/212 |
| 6,321,737 | B1 | | 11/2001 | Johnson | 124/73 |
| 6,324,981 | B1 | * | 12/2001 | Siegler et al. | 102/361 |
| 6,508,178 | B2 | * | 1/2003 | Shelton | 102/361 |

FOREIGN PATENT DOCUMENTS

| | | | | |
|---|---|---|---|---|
| JP | 4-103999 | * | 4/1992 | 102/361 |

OTHER PUBLICATIONS

National Geographic Gift Catalog Spring, 2002, p. 13.

* cited by examiner

*Primary Examiner*—Michael J. Carone
*Assistant Examiner*—James S. Bergin
(74) *Attorney, Agent, or Firm*—E. Alan Uebler, PA

(57) ABSTRACT

Pyrotechnic fireworks launch apparatus is provided. The apparatus includes a base to which is affixed a male-configured launching cylinder adapted to accept thereover, in combination, an internally cylindrical, female-configured projectile, wherein the projectile has a proximal and a distal end thereof. The projectile houses a fused pyrotechnic display charge proximate its distal end and also houses a fused launching charge encased therein and partitioned from the display charge. On insertion of the launching cylinder into the proximal end of the projectile, thereby mounting the projectile upon the launching cylinder, the encased launching charge and the launching cylinder are in abutting relationship. Upon ignition of the fused launch charge, the projectile is launched vertically from the launching cylinder. The external configuration of the projectile may have any number of shapes. In a preferred configuration, it is shaped as a rocket.

41 Claims, 5 Drawing Sheets

PYROTECHNIC PROJECTILE LAUNCHER

BACKGROUND OF THE INVENTION

The present invention relates to reusable apparatus for launching pyrotechnic projectiles, e.g. at fireworks displays.

Pyrotechnic projectiles have generally been launched from tubes such as mortar tubes. The vertically oriented mortar tube is generally affixed to a base and the pyrotechnic projectile is slidably inserted into the launch tube, to be propelled therefrom vertically upon ignition of a fused impulse cartridge affixed to the rear end of the projectile. On ignition, the exploding launch charge develops gas pressure within the mortar tube causing the projectile to be expelled from the tube and projected vertically upwardly through and out of the mortar tube. A recent U.S. Patent, U.S. Pat. No. 6,286,429B1, discloses one such device.

Such mortar tube launchers have been made from paper, cardboard and plastic. Such launchers can be damaged or destroyed upon use, and some can not be reused safely to launch additional projectiles after the first. Reusable mortar tubes have been made of metal and of high strength plastics, but at substantially elevated costs.

Mortar tube pyrotechnic launchers have additional disadvantages. They are prone to accidents resulting from launch personnel prematurely looking down the muzzle of the mortar tube to determine its firing status. Burning or smoldering debris can be concealed at the bottom of the mortar tube from previous launches, causing premature ignition of subsequent loaded projectiles. Also, an ignited fuse can fall into such tube and out of sight, thereby rendering an explosive situation undetectable using ordinary precautions. In addition, internal damage, i.e. weak spots, in the walls of such tubes are difficult to detect. Further, rocket design con-figuration and the imagination of the rocket designer are constrained to projectile configurations which will fit down inside a cylindrical mortar launch tube.

These disadvantages of conventional pyrotechnic projectile mortar tube launchers are substantially overcome by the apparatus of the present invention. The invention is described fully in the following specification and in the accompanying drawings.

SUMMARY OF THE INVENTION

Pyrotechnic fireworks launch apparatus is provided. The apparatus includes a base to which is affixed a male-configured launching cylinder. The launching cylinder is adapted to accept thereover, in combination, an internally cylindrical, female-configured projectile, wherein the projectile has a proximal and a distal end thereof. The projectile houses a fused pyrotechnic display charge proximate its distal end and also houses a fused launching charge encased therein and partitioned from the display charge. On insertion of the launching cylinder into the proximal end of the projectile, thereby mounting the projectile upon the launching cylinder, the encased launching charge and the launching cylinder are in abutting relationship. Upon ignition of the fused launch charge, the projectile is launched vertically from the launching cylinder. The launching cylinder may be a solid, cylindrical rod or a hollow, cylindrical tube. The fuse of the fused launching charge extends through the launch charge housing and to the surrounding environment. The fuse of the fused pyrotechnic display charge extends through the partition between the launching charge and the display charge.

The projectile may have aerodynamic guidance means such as fins affixed to the projectile, which fins may be oriented at an angle to the longitudinal axis of the projectile.

Additional vanes may be attached thereto to impart rotation to the projectile. The projectile preferably has at least three fins, most preferably having four fins.

The launching charge may be black powder.

In the apparatus of the invention, the projectile housing preferably has a proximal end thereof angled to the horizontal such that the projectile can not stand alone on a horizontal surface upon its proximal end in a free-standing configuration. In this embodiment, the projectile can not be mistakenly observed as ready-to-fire, since it cannot stand vertically on its own.

The launching cylinder may be wood, cardboard, plastic or metal. Preferably the housing of the projectile is cardboard, paper or plastic.

The external configuration of the projectile may have any number of shapes. In a preferred configuration, it is shaped as a rocket. Additionally, clearly, the external configuration of the projectile may be shaped as an airplane, as an insect, as a building structure, including, e.g., Tower of London, the Eiffel Tower, the Empire State Building, the Statue of Liberty, or, e.g., a lighthouse. The external configuration of the projectile may have other shapes such as a fairy, or as a super hero such as Superman®, Batman®, Spider-Man® or Boom Man™. The projectile may be shaped as a badminton shuttlecock, an oil rig, as the space needle, or as any recognizable configuration limited only by the designer's imagination.

Multiple units of the apparatus of the invention may be all fused together serially, whereby, upon ignition of one unit, all units are ignited sequentially to produce an even more spectacular display.

BRIEF DESCRIPTION OF THE DRAWINGS

In the accompanying drawings.

DETAILED DESCRIPTION OF THE INVENTION AND PREFERRED EMBODIMENTS IN REFERENCE TO THE DRAWINGS

Pyrotechnic fireworks launch apparatus is provided. The apparatus includes a base to which is affixed a male-configured launching cylinder adapted to accept thereover, in combination, an internally cylindrical, female-configured projectile, wherein the projectile has a proximal and a distal end thereof. The projectile houses a fused pyrotechnic display charge proximate its distal end and also houses a fused launching charge encased therein and partitioned from the display charge. On insertion of the launching cylinder into the proximal end of the projectile, thereby mounting the projectile upon the launching cylinder, the encased launching charge and the launching cylinder are in abutting relationship. Upon ignition of the fused launch charge, the projectile is launched vertically from the launching cylinder. The external configuration of the projectile may have any number of shapes. In a preferred configuration, it is shaped as a rocket. The external configuration of the projectile may be shaped as an airplane, as an insect, as a building structure, a fairy, a super hero, a badminton shuttlecock, an oil rig, as the space needle, or as any other recognizable configuration. Multiple units of the apparatus may be fused together serially, whereby, upon ignition of one unit, all units are ignited in succession.

Figure 1:
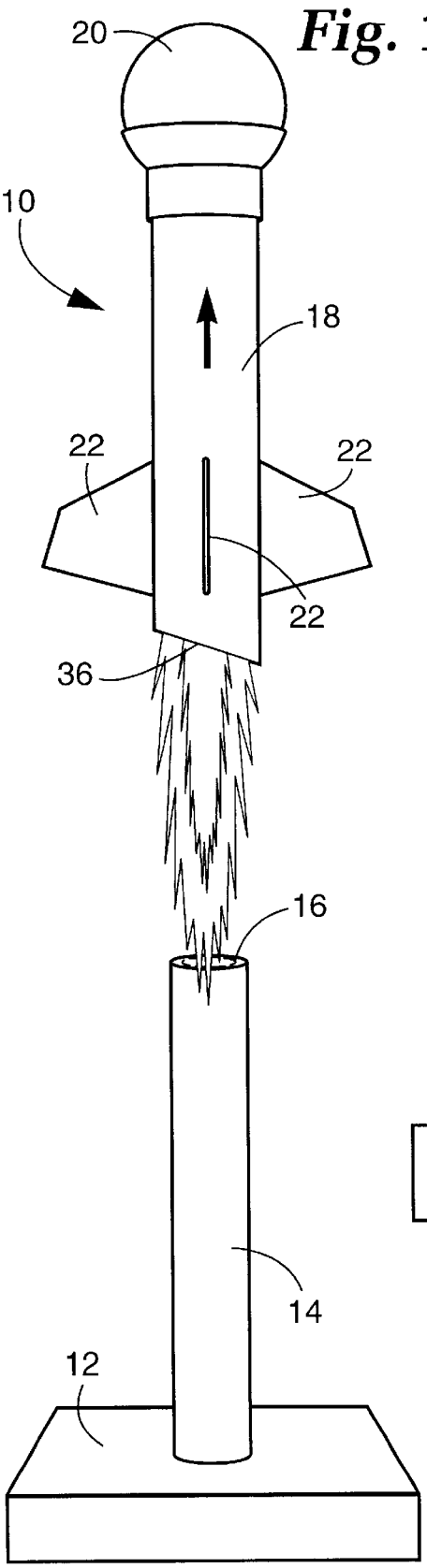
FIG. 1 is an elevational view of one embodiment of the pyrotechnic fireworks launching apparatus according to the invention.

A detailed description of the invention and preferred embodiments is best provided with reference to the accompanying drawings wherein FIG. 1 depicts a preferred configuration of the launch apparatus of the invention. Therein, the apparatus 10 includes the base 12, which supports the apparatus on a launch surface such as the ground. Affixed to the base 12 is a male-configured launch cylinder 14. The cylinder 14 may be solid or hollow, as indicated by the bore 16 therethrough, and both are preferred. The projectile being launched has the general shape of a rocket including display charge housing 20 at the distal end of the tubular, female-configured rocket body 18, which slidably fits over the launch cylinder 14. The rocket projectile has guidance fins 22 and a proximal end 36 which is angled to the horizontal and which is described in more detail below.

The launch cylinder 14 and projectile body 18 may be constructed of any suitable materials to suit a given designer, and such will be apparent to those skilled in the art. For example, cylinder 14 may be wood, cardboard, paper, plastic or metal. Cylinder body 18 may be cardboard, paper, plastic or other suitable materials.

Figure 2:
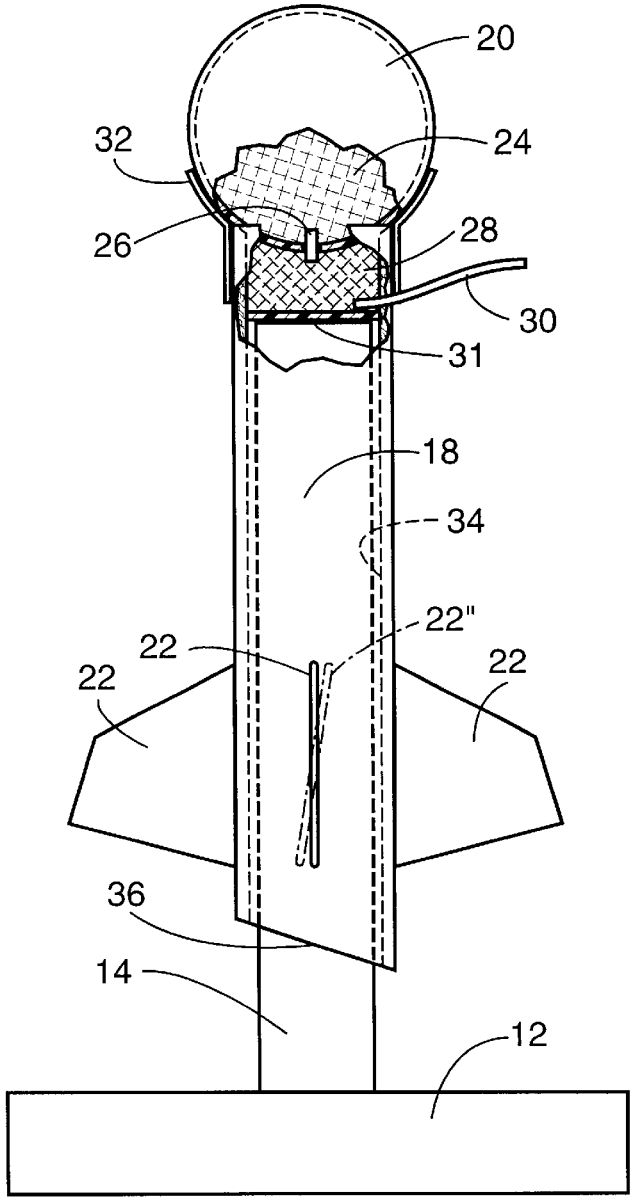
FIG. 2 is an elevational view of the launch apparatus of FIG. 1, partly broken away and partly in cross-section, in its pre-launch, pre-ignition mode.

FIG. 2 depicts the launching apparatus shown in FIG. 1, but in its pre-launch mode, partly broken away and partly in cross-section. Therein, the hollow-bodied projectile having display charge 24 contained within housing 20 positioned at the distal end of cylindrical rocket body 18 includes the launching charge 28 having fuse 30 inserted therein. The launch charge 28 is separate from and physically separated from the display charge 24 by the wall of housing 20 in this embodiment. Disk 31 contains the launch charge 28 within cylinder body 18 prior to ignition. The separating disk 31 may be paper, cardboard or clay. Extending through housing wall 20 is fuse 26, passing from within the launch charge 28 into the display charge 24. Support fixture 32 holds the components in place prior to launch.

Rocket body 18 is slidably engaged with cylinder 14 which is inserted into the bore 34 of the cylinder 18. Affixed to the outside of cylinder 18 are guidance fins 22, which may be angled slightly to provide spin, as indicated by the dashed configuration 22' shown in the figure.

The proximal end 36 of the rocket body 18 is angled as indicated, at a suitable angle sufficient to prevent the projectile from standing in a free-standing mode. In this way, the rocket projectile cannot be stood upright without cylinder 14, and therefore cannot be mistakenly believed to be in a firing mode.

In operation, upon ignition of fuse 30, launch charge 28 ignites, thereby also igniting fuse 26 and launching the projectile from the cylinder 14. The fuse 26 burns during launch and is designed so as to ignite the display charge 24 when the projectile is at the apex of its flight, thereby creating the most spectacular display possible.

In this launch mode, as compared to the conventional mortar tube launch, which is, in a sense, precisely the opposite in principle to the mortar tube, the launch forces are less stressful on launch rod 14, resulting in longer life and permitting reuse. In addition, any damage to the launch means (rod 14) is readily and visibly apparent. So, also, the launch charge ignition fuse 30 is always visible, thereby further enhancing the safety aspects associated with this invention.

Figure 3:
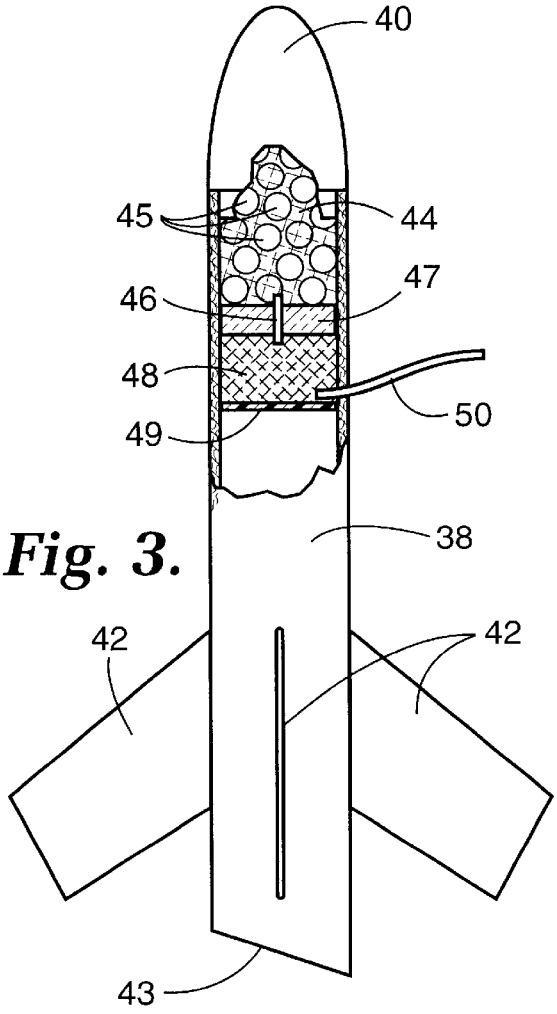
FIG. 3 is an elevational view of another embodiment of a projectile which may be launched according to the invention.

FIG. 3 depicts an alternate projectile useful in the apparatus of the invention. Therein a rocket-like projectile is shown having a blunt-nosed display charge housing 40 containing display charge 44, which includes exploding stars 45, all housed at the distal end of cylinder 38. Shown in the broken away section are the display charge fuse 46 which ignitably connects the display charge 44 to the launch charge 48. The two charges are separated by partition or disk 47, which may be clay or cardboard. The launch charge 48 is confined by disk 49. Ignition fuse 50 extends through the wall of cylinder 38 as shown. Angled fins 42 provide for aerodynamic guidance and angled proximal end 43 is provided for the reasons previously discussed.

Figure 4:
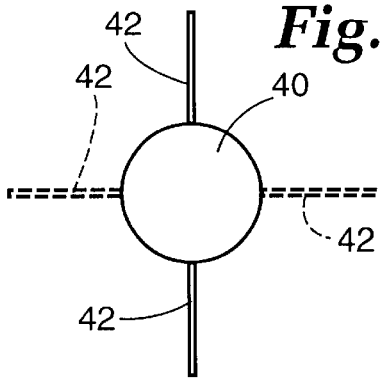
FIG. 4 depicts one configuration of fins useful for aerodynamic guidance of the rocket-shaped projectile of FIG. 3.

FIG. 4 depicts a top plan view of the rocket of FIG. 3, showing display charge housing 40 and indicating the orientation of four fins 42.

Figure 5:
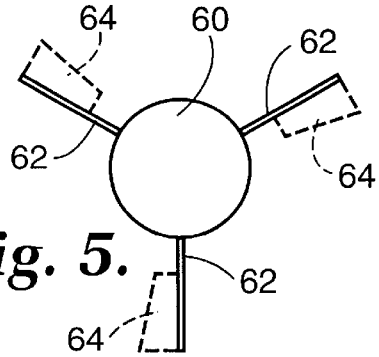
FIG. 5 shows an alternate fin guidance configuration, wherein three fins are employed.

FIG. 5 shows an alternate rocket-like projectile 60 having fins 62 and additional, optional vanes 64 which impart added spin upon launch.

Figure 6:
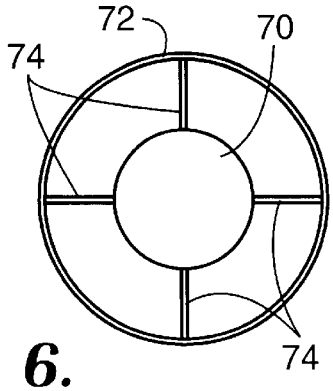
FIG. 6 illustrates a still further fin configuration wherein the fin extends circumferentially around the base of the projectile, held in place by struts.
Figure 7:
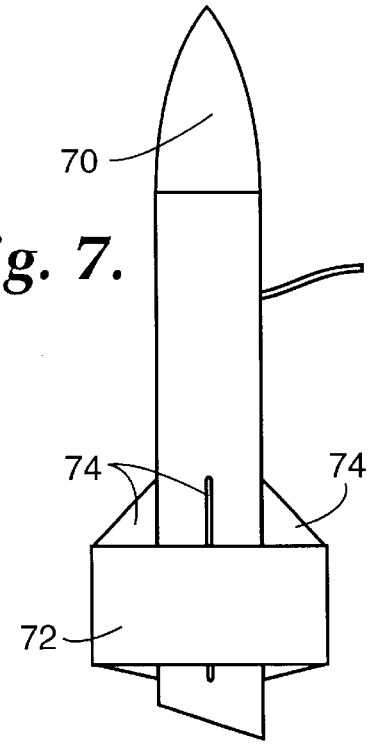
FIG. 7 is an elevation of a rocket-shaped projectile having the circumferential fin assembly of FIG. 6.

FIG. 6 shows a further alternate rocket-like projectile having a circumferential fin 72 extending around the rocket 70 and supported thereat by struts 74, this same rocket being shown in elevation in FIG. 7.

Figure 8:
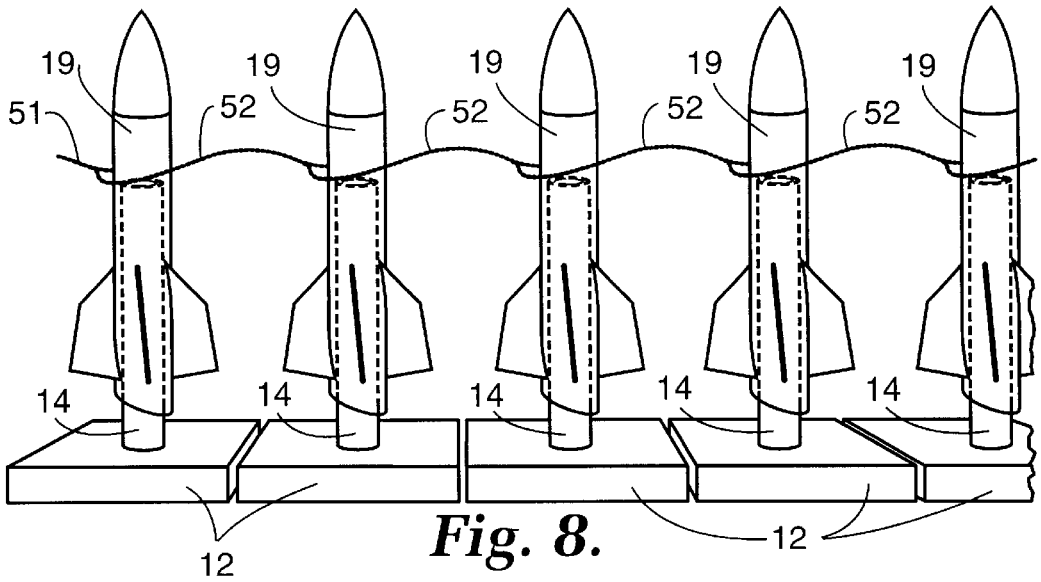
FIG. 8 illustrates a plurality of pyrotechnic rocket-shaped assemblies of the invention fused together to enable sequential firing.
Figure 9:
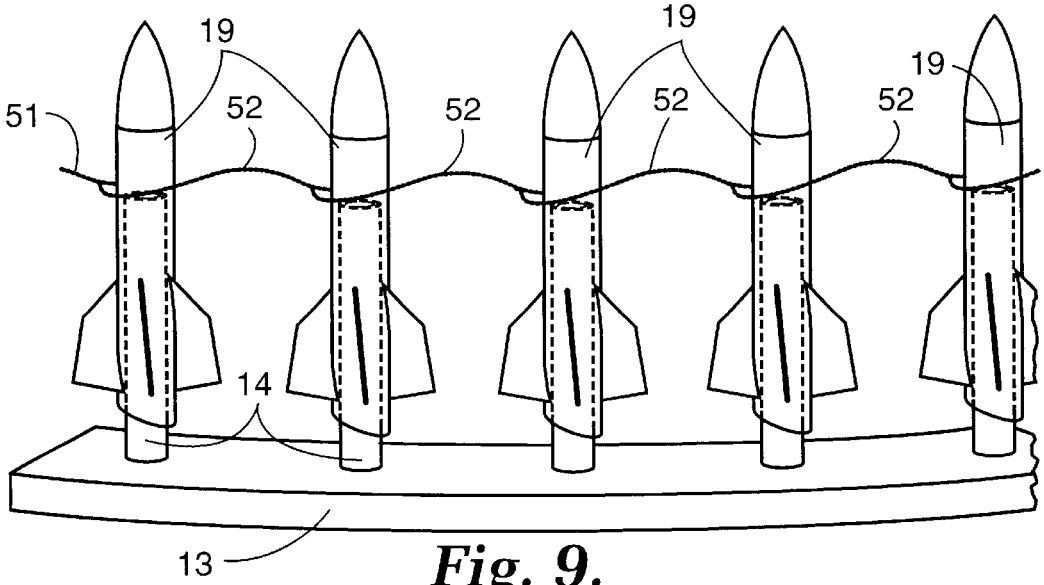
FIG. 9 illustrates a plurality of the pyrotechnic rocket-shaped assemblies of the invention connected by a common fuse, all being mounted on a common base.

FIG. 8 shows multiple launchers of the invention having projectile bodies 19 connected together serially by common fuse 52 to provide, upon ignition of the single first fuse 51, sequential launching of the plurality of rockets depicted. All of the rocket-like projectiles shown are depicted having separate bases 12. A plurality of similar rocket-like projectiles may also be employed as shown in FIG. 9, all installed on a common base 13.

Figure 10:
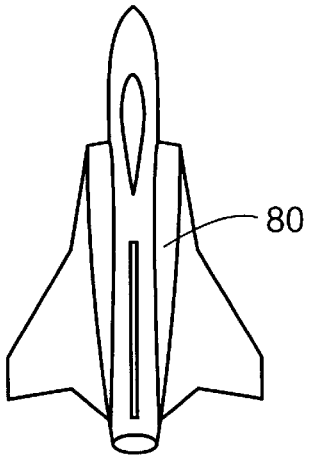
FIGS. 10 (top plan) and 11 (side elevation) illustrate, schematically, a projectile in the form of a fighter plane.
Figure 11:
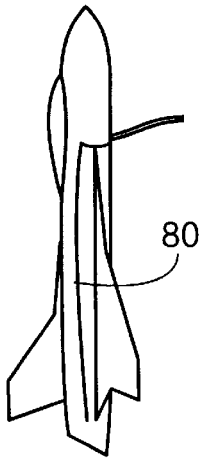

FIG. 10 shows a top plan view of a rocket configured as a fighter plane, and FIG. 11 shows the fighter plane 80 in a side elevational view.

Figure 12:
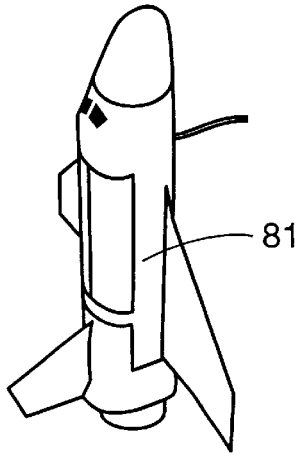
FIG. 12 illustrates a projectile in the form of the space shuttle.

FIG. 12 shows a perspective view of the projectile 81 depicted as the space shuttle.

Figure 13:
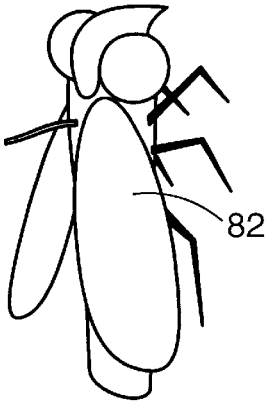
FIG. 13 illustrates a projectile in the form of an insect.

FIG. 13 shows the projectile 82 depicted as an insect.

Figure 14:
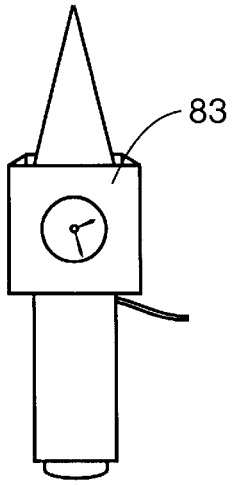
FIG. 14 illustrates a projectile in the form of a tower clock (Tower of London).

FIG. 14 shows the projectile 83 depicted as a clock tower, simulating the Tower of London.

Figure 15:
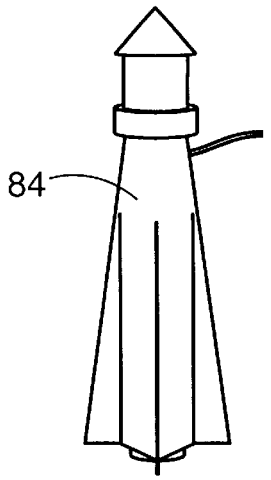
FIG. 15 illustrates a projectile in the form of a lighthouse.

FIG. 15 shows the projectile 84 depicted as a lighthouse.

Figure 16:
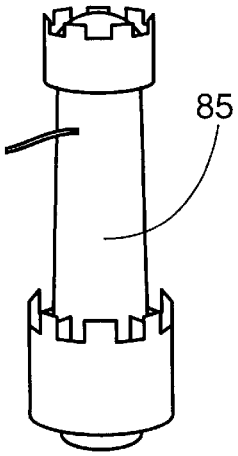
FIG. 16 illustrates a projectile in the form of a castle.

FIG. 16 shows the projectile 85 depicted as a castle.

Figure 17:
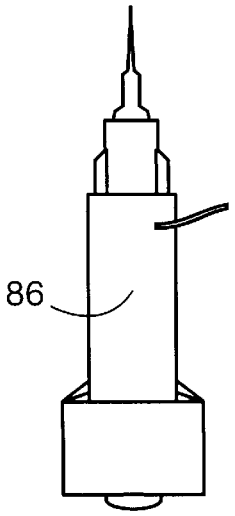
FIG. 17 illustrates a projectile in the form of the Empire State Building.

FIG. 17 shows the projectile 86 depicted as the Empire State Building.

Figure 18:
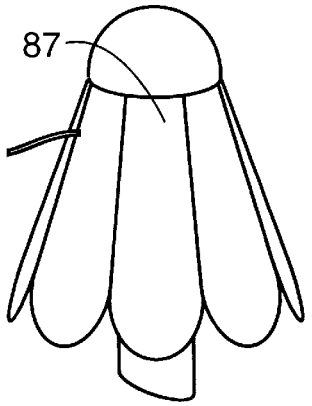
FIG. 18 illustrates a projectile in the form of a badminton shuttlecock.

FIG. 18 shows the projectile 87 depicted as a badminton shuttlecock.

Figure 19:
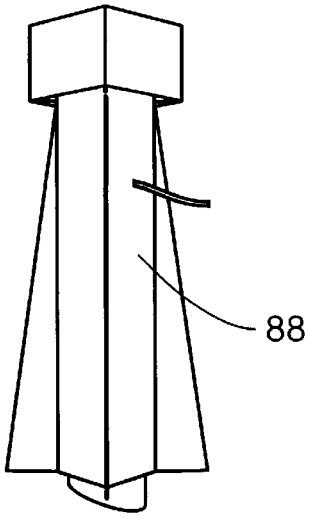
FIG. 19 illustrates a projectile in the form of an oil rig.

FIG. 19 shows the projectile 88 depicted as an oil rig.

Figure 20:
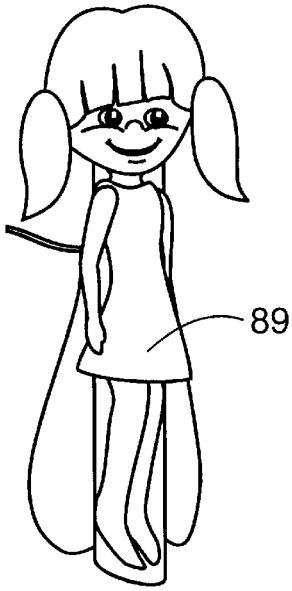
FIG. 20 illustrates a projectile in the form of a fairy.

FIG. 20 shows the projectile 89 depicted as a fairy.

Figure 21:
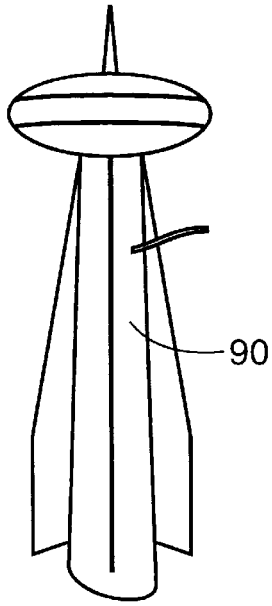
FIG. 21 illustrates a projectile in the form of a space needle.

FIG. 21 shows the projectile 90 depicted as the space needle.

Figure 22:
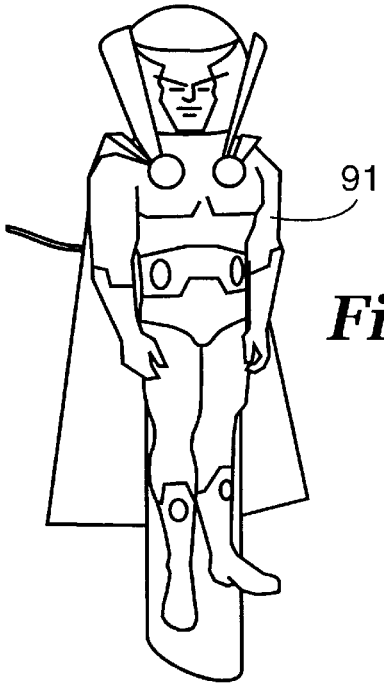
FIG. 22 illustrates a projectile in the form of a super hero.

FIG. 22 shows the projectile 91 depicted as a super hero.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Pyrotechnic fireworks launch apparatus comprising, in combination:

a base, to which base is affixed a male-configured launching cylinder, said launching cylinder adapted to accept thereover an internally hollow, cylindrical, female-configured projectile having an open proximal end thereof, said projectile housing a fused pyrotechnic display charge proximate its distal end thereof, the projectile also housing proximate its distal end a fused launching charge encased therein and partitioned from said display charge, such that, on insertion of said launching cylinder into the open proximal end of said projectile, thereby mounting said projectile upon said launching cylinder, the encased launching charge and the launching cylinder are in abutting relationship.

2. The launch apparatus of claim 1 wherein said launching cylinder is a solid, cylindrical rod.

3. The launch apparatus of claim 1 wherein said launching cylinder is a hollow, cylindrical tube.

4. The apparatus of claim 1 wherein the fuse of said fused launching charge extends through said housing and to the surrounding environment.

5. The apparatus of claim 1 wherein the fuse of said fused pyrotechnic display charge extends through the partition between said launching charge and said display charge.

6. The apparatus of claim 1 wherein said projectile has aerodynamic guidance means.

7. The apparatus of claim 6 wherein said aerodynamic guidance means are fins affixed to said projectile.

8. The apparatus of claim 7 wherein said fins are oriented at an angle to the longitudinal axis of said projectile.

9. The apparatus of claim 7 having at least three fins.

10. The apparatus of claim 7 having three fins.

11. The apparatus of claim 7 having four fins.

12. The apparatus of claim 6 having vanes attached thereto to impart rotation to said projectile.

13. The apparatus of claim 1 wherein said launching charge is black powder.

14. The apparatus of claim 1 wherein said projectile housing has a proximal end thereof angled to the horizontal such that said projectile can not stand alone on a horizontal surface upon said proximal end in a free-standing configuration.

15. The apparatus of claim 1 wherein said launching cylinder is wood.

16. The apparatus of claim 1 wherein said launching cylinder is cardboard.

17. The apparatus of claim 1 wherein said launching cylinder is paper.

18. The apparatus of claim 1 wherein said launching cylinder is plastic.

19. The apparatus of claim 1 wherein said launching cylinder is metal.

20. The apparatus of claim 1 wherein said housing of said projectile is cardboard.

21. The apparatus of claim 1 wherein said housing of said projectile is paper.

22. The apparatus of claim 1 wherein said housing of said projectile is plastic.

23. The apparatus of claim 1 wherein the external configuration of said projectile is shaped as a rocket.

24. The apparatus of claim 1 wherein the external configuration of said projectile is shaped as an airplane.

25. The apparatus of claim 1 wherein the external configuration of said projectile is shaped as an insect.

26. The apparatus of claim 1 wherein the external configuration of said projectile is shaped as a building structure.

27. The apparatus of claim 26 wherein the external configuration of said projectile is shaped as the Tower of London.

28. The apparatus of claim 26 wherein the external configuration of said projectile is shaped as the Empire State Building.

29. The apparatus of claim 26 wherein the external configuration of said projectile is shaped as the Statue of Liberty.

30. The apparatus of claim 26 wherein the external configuration of said projectile is shaped as a lighthouse.

31. The apparatus of claim 1 wherein the external configuration of said projectile is shaped as a fairy.

32. The apparatus of claim 1 wherein the external configuration of said projectile is shaped as a super hero.

33. The apparatus of claim 32 wherein the external configuration of said projectile is as Superman®.

34. The apparatus of claim 32 wherein the external configuration of said projectile is as Batman®.

35. The apparatus of claim 32 wherein the external configuration of said projectile is as Spider-Man®.

36. The apparatus of claim 32 wherein the external configuration of said projectile is as Boom Man™.

37. The apparatus of claim 1 wherein the external configuration of said projectile is shaped as a shuttlecock.

38. The apparatus of claim 1 wherein the external configuration of said projectile is shaped as an oil rig.

39. The apparatus of claim 1 wherein the external configuration of said projectile is shaped as the space needle.

40. The apparatus of claim 1 wherein the external configuration of said projectile is shaped, generally, into a recognizable configuration.

41. Multiple units of the apparatus of claim 1 all fused together serially, whereby, upon ignition of one unit, all units are ignited sequentially.

* * * * *